US010510220B1

(12) United States Patent
Moore, Jr. et al.

(10) Patent No.: US 10,510,220 B1
(45) Date of Patent: Dec. 17, 2019

(54) INTELLIGENT ALARM SOUND CONTROL

(71) Applicant: INTERNATIONAL BUSINESS MACHINES CORPORATION, Armonk, NY (US)

(72) Inventors: John E. Moore, Jr., Pflugerville, TX (US); Janet Van, Round Rock, TX (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 16/056,233

(22) Filed: Aug. 6, 2018

(51) Int. Cl.

| | |
|---|---|
| ***G10K 11/16*** | (2006.01) |
| ***G08B 3/10*** | (2006.01) |
| ***G10K 11/178*** | (2006.01) |
| ***H04R 1/34*** | (2006.01) |
| ***G10K 11/00*** | (2006.01) |
| ***G10K 11/34*** | (2006.01) |
| ***G04B 33/00*** | (2006.01) |
| ***G04C 21/16*** | (2006.01) |
| ***G10K 11/18*** | (2006.01) |
| ***G04C 21/00*** | (2006.01) |
| ***G04G 11/00*** | (2006.01) |
| ***G04B 33/02*** | (2006.01) |
| ***G10K 11/26*** | (2006.01) |

(52) U.S. Cl.
CPC ..... *G08B 3/10* (2013.01); *G04B 33/00* (2013.01); *G04B 33/02* (2013.01); *G04C 21/00* (2013.01); *G04C 21/16* (2013.01); *G04G 11/00* (2013.01); *G10K 11/00* (2013.01); *G10K 11/17827* (2018.01); *G10K 11/18* (2013.01); *G10K 11/26* (2013.01); *G10K 11/34* (2013.01); *H04R 1/345* (2013.01)

(58) Field of Classification Search
CPC ..... G08B 3/10; G04C 21/00; G04C 21/16; G04G 11/00; G04B 33/00; G04B 33/02; G10K 11/00; G10K 11/18; G10K 11/26; G10K 11/34
See application file for complete search history.

(56) References Cited

U.S. PATENT DOCUMENTS

| | | | | |
|---|---|---|---|---|
| 6,778,081 | B2 | 8/2004 | Matheny | |
| 7,146,011 | B2 | 12/2006 | Yang et al. | |
| 7,194,094 | B2 | 3/2007 | Horrall et al. | |
| 7,649,444 | B1 * | 1/2010 | Fear | B60Q 5/00 340/384.1 |
| 7,801,570 | B2 | 9/2010 | Cheung et al. | |
| 8,457,324 | B2 | 6/2013 | Tice | |
| 9,513,602 | B1 * | 12/2016 | Russell | G04B 23/02 |
| 9,635,483 | B2 | 4/2017 | Francombe et al. | |
| 2009/0256709 | A1 * | 10/2009 | Davis | A61B 5/0002 340/573.1 |
| 2011/0096637 | A1 * | 4/2011 | Chiang | G04C 19/02 368/256 |

(Continued)

FOREIGN PATENT DOCUMENTS

WO 2011117903 A3 9/2011

*Primary Examiner* — Andrew W Bee
(74) *Attorney, Agent, or Firm* — Griffiths & Seaton PLLC

(57) ABSTRACT

Embodiments for implementing intelligent alarm sound control by a processor. A targeted entity may be isolated for a generated sound to be delivered, while noise cancellation is simultaneously provided to prevent an alternative entity from being disturbed by the isolated sound.

17 Claims, 8 Drawing Sheets

(56) References Cited

U.S. PATENT DOCUMENTS

| | | | | |
|---|---|---|---|---|
| 2016/0195856 | A1* | 7/2016 | Spero | G06N 5/046 700/90 |
| 2017/0323630 | A1* | 11/2017 | Stickney | G10K 11/178 |
| 2018/0163650 | A1* | 6/2018 | Serrano | G10K 11/16 |

* cited by examiner

INTELLIGENT ALARM SOUND CONTROL

BACKGROUND OF THE INVENTION

Field of the Invention

The present invention relates in general to computing systems, and more particularly to, various embodiments for implementing intelligent alarm sound control using a computing processor.

Description of the Related Art

In today's society, consumers, business persons, educators, and others use various computing network systems with increasing frequency in a variety of settings. The advent of computers and networking technologies have made possible the increase in the quality of life while enhancing day-to-day activities. Computing systems can include an Internet of Things (IoT), which is the interconnection of computing devices scattered across the globe using the existing Internet infrastructure. IoT devices may be embedded in a variety of physical devices or products.

As great strides and advances in technologies come to fruition, these technological advances can be then brought to bear in everyday life. For example, the vast amount of available data made possible by computing and networking technologies may then assist in improvements to quality of life and appropriate living conditions.

SUMMARY OF THE INVENTION

Various embodiments implementing intelligent alarm sound control by a processor are provided. In one embodiment, by way of example only, a method for implementing intelligent alarm sound control by is provided. A targeted entity may be isolated for a generated sound to be delivered, while noise cancellation is simultaneously provided to prevent an alternative entity from being disturbed by the isolated sound.

In an additional aspect, a directional sound may be provided, using one or more internet of things (IoT) computing devices, within a cone of silence for waking a targeted, sleeping entity while simultaneously providing noise cancellation operation for preventing an alternative sleeping entity from being disturbed by the directional sound.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE DRAWINGS

Figure 1:
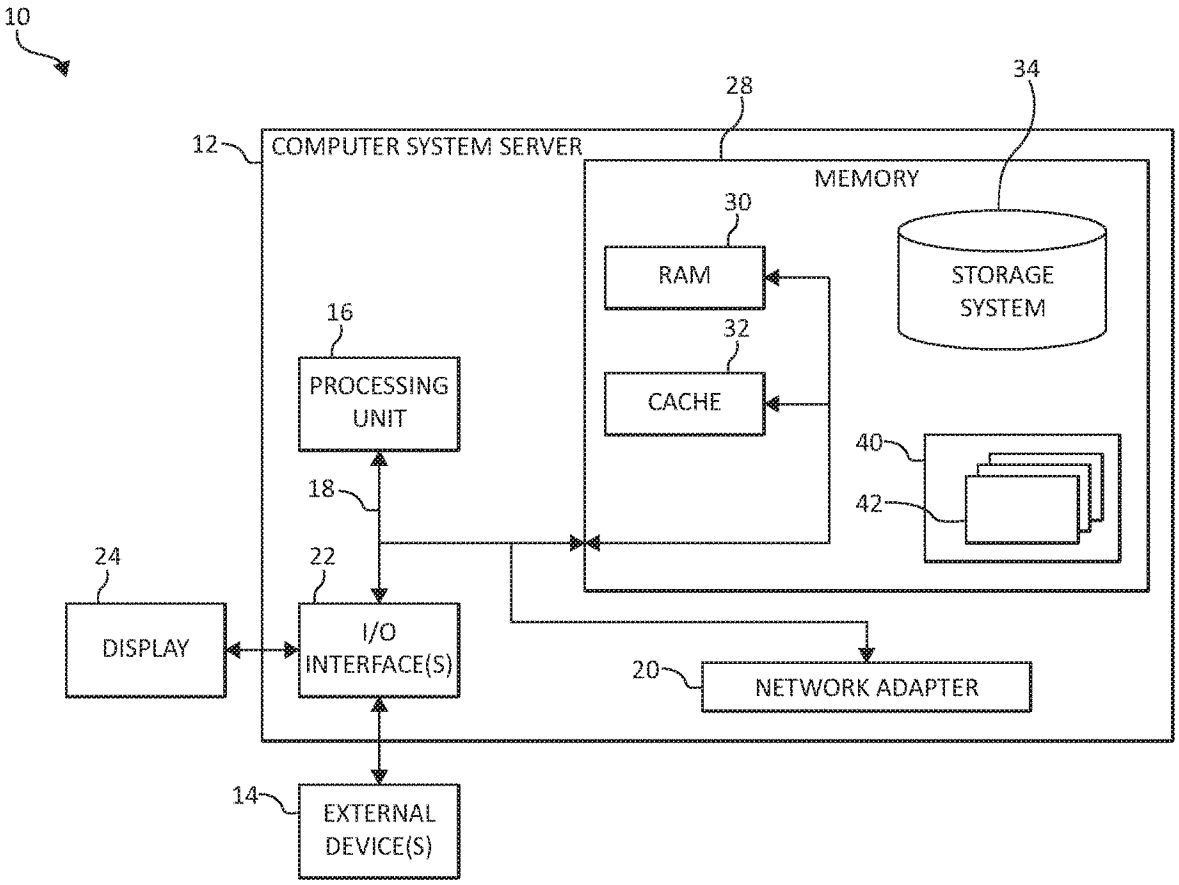
FIG. 1 is a block diagram depicting an exemplary cloud computing node according to an embodiment of the present invention.

As a preliminary matter, computing systems may include large scale computing called "cloud computing," in which resources may interact and/or be accessed via a communications system, such as a computer network. Resources may be software-rendered simulations and/or emulations of computing devices, storage devices, applications, and/or other computer-related devices and/or services run on one or more computing devices, such as a server. For example, a plurality of servers may communicate and/or share information that may expand and/or contract across servers depending on an amount of processing power, storage space, and/or other computing resources needed to accomplish requested tasks. The word "cloud" alludes to the cloud-shaped appearance of a diagram of interconnectivity between computing devices, computer networks, and/or other computer related devices that interact in such an arrangement.

The Internet of Things (IoT) is an emerging concept of computing devices that may be embedded in objects, especially appliances, and connected through a network. An IoT network may include one or more IoT devices or "smart devices", which are physical objects such as appliances with computing devices embedded therein. Examples of network-enabled appliances or devices may include computers, smartphones, laptops, wearable devices, sensor devices, voice-activated devices, face-activated devices, digital assistants, home appliances, audio systems, televisions, security cameras, security sensors, among countless other examples. Such IoT computing systems may be employed in a variety of settings.

For example, many individuals rely on an alarm clock/IoT device to assist them in starting their day on time. Some dread the trauma of waking up to the sound of a shrieking alarm and quickly hit the snooze/silence button to silence the alarm and drag out the wakeup process. Further complicating matters is when an alarm clock is used to waken a sleeping person, but other persons present in the same room wish to continue sleeping without being disturbed by the alarm clock. Hence, challenges arise when a person is setting their alarm devices to awake them at a certain time with a set tone and/or vibration, but such an alarm can and will awake other persons that may be around and/or near the area the alarm resides.

Thus, the present invention provides for implementing a cognitive alarm sound control system. A targeted entity may be isolated for a generated sound to be delivered, while noise cancellation is simultaneously provided to prevent an alternative entity from being disturbed by the isolated sound.

In one embodiment, a directional sound may be provided and controlled, using one or more IoT computing devices, within a cone of silence for waking a targeted, sleeping entity (e.g., person) while simultaneously providing a noise cancellation operation for preventing an alternative sleeping entity from being disturbed by the directional sound. The directional sound may be configured according to one or more physical properties such as, for example, adjusting/changing sound tone, volume, frequency, pattern, etc.

Thus, the present invention provides for waking one entity from sleep without disturbing other persons around or near a sound generating IoT device (e.g., an IoT device functioning as an alarm clock). A noise cancelling IoT device may be paired with the IoT alarm device based on a predictive frequency, volume, and wavelength. In this way, people sharing the same bed may only be woken up by their IoT alarm device, allowing the other parties to remain sleeping and undisturbed. Furthermore, the intelligent alarm sound control system may communicate with other devices such as, for example, one or more IoT computing devices (e.g., wireless communication phones, wearable monitoring devices).

It should be noted that sound is a pressure wave, which consists of a compression phase and a rarefaction phase. A noise-cancellation device, as used herein, may emit a sound wave with the same amplitude (and/or predictive frequency, volume, and wavelength) but with an inverted phase (also known as antiphase) to the original sound. The waves combine to form a new wave, in a process called interference, and effectively cancel each other out (e.g., destructive interference and/or phase cancellation). Said differently, the noise-cancellation device may apply an adaptive operation to analyze the waveform of the background aural or non-aural noise. The noise-cancellation device may generate a signal that may phase shift or invert the polarity of the original signal. This inverted signal (in antiphase) is then amplified and a transducer creates a sound wave directly proportional to the amplitude of the original waveform, creating the destructive interference. Said differently, the noise-cancellation device may pair the noise cancellation with the generated sound according to a predictive frequency, volume, and wavelength.

In an additional aspect, the mechanisms of the illustrated embodiments, among other aspects, provide for learning, identifying and using activities of daily living (ADLs), context of daily living (CDLs), and a well-being of a user for cognitively using of the learning sleep patterns, habits, and/or behaviors for dynamically activating the intelligent alarm sound control system using one or more AI services such as, for example, using instance of IBM® Watson® such as Watson® Assistant, Watson® Personality Insight, and/or Watson® Tone Analyzer cloud service. (IBM® and Watson® are trademarks of International Business Machines Corporation.).

It should be noted as described herein, the term "cognitive" (or "cognition") may be relating to, being, or involving conscious intellectual activity such as, for example, thinking, reasoning, or remembering, that may be performed using machine learning. In an additional aspect, cognitive or "cognition" may be the mental process of knowing, including aspects such as awareness, perception, reasoning and judgment. A machine learning system may use artificial reasoning to interpret data from one or more data sources (e.g., sensor-based devices or other computing systems) and learn topics, concepts, and/or processes that may be determined and/or derived by machine learning.

In an additional aspect, cognitive or "cognition" may refer to a mental action or process of acquiring knowledge and understanding through thought, experience, and one or more senses using machine learning (which may include using sensor-based devices or other computing systems that include audio or video devices). Cognitive may also refer to identifying patterns of behavior, leading to a "learning" of one or more problems, domains, events, operations, or processes. Thus, the cognitive model may, over time, develop semantic labels to apply to observed behavior, domains, problems, and use a knowledge domain or ontology to store the learned observed behavior, problems, and domain. In one embodiment, the system provides for progressive levels of complexity in what may be learned from the one or more dialogs, operations, or processes.

In an additional aspect, the term cognitive may refer to a cognitive system. The cognitive system may be a specialized computer system, or set of computer systems, configured with hardware and/or software logic (in combination with hardware logic upon which the software executes) to emulate human cognitive functions. These cognitive systems apply human-like characteristics to convey and manipulate ideas which, when combined with the inherent strengths of digital computing, can solve problems with a high degree of accuracy (e.g., within a defined percentage range or above an accuracy threshold) and resilience on a large scale. A cognitive system may perform one or more computer-implemented cognitive operations that approximate a human thought process while enabling a user or a computing system to interact in a more natural manner. A cognitive system may comprise artificial intelligence logic, such as natural language processing (NLP) based logic, for example, and machine learning logic, which may be provided as specialized hardware, software executed on hardware, or any combination of specialized hardware and software executed on hardware. The logic of the cognitive system may implement the cognitive operation(s), examples of which include, but are not limited to, question answering, identifying problems, identification of related concepts within different portions of content in a corpus, and intelligent search algorithms, such as Internet web page searches.

In general, such cognitive systems are able to perform the following functions: 1) Navigate the complexities of human language and understanding; 2) Ingest and process vast amounts of structured and unstructured data; 3) Generate and evaluate hypotheses; 4) Weigh and evaluate responses that are based only on relevant evidence; 5) Provide situation-specific advice, insights, estimations, determinations, evaluations, calculations, and guidance; 6) Improve knowledge and learn with each iteration and interaction through machine learning processes; 7) Enable decision making at the point of impact (contextual guidance); 8) Scale in proportion to a task, process, or operation; 9) Extend and magnify human expertise and cognition; 10) Identify resonating, human-like attributes and traits from natural language; 11) Deduce various language specific or agnostic attributes from natural language; 12) Memorize and recall relevant data points (images, text, voice) (e.g., a high degree of relevant recollection from data points (images, text, voice) (memorization and recall)); and/or 13) Predict and sense with situational awareness operations that mimic human cognition based on experiences.

Additional aspects of the present invention and attendant benefits will be further described, following.

It is understood in advance that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security parameters, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Referring now to FIG. 1, a schematic of an example of a cloud computing node is shown. Cloud computing node 10 is only one example of a suitable cloud computing node and is not intended to suggest any limitation as to the scope of use or functionality of embodiments of the invention described herein. Regardless, cloud computing node 10 is capable of being implemented and/or performing any of the functionality set forth hereinabove.

In cloud computing node 10 there is a computer system/server 12, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 1, computer system/server 12 in cloud computing node 10 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, system memory 28 may include at least one program product having a set (e.g., at least one) of program modules that are configured to carry out the functions of embodiments of the invention.

Program/utility 40, having a set (at least one) of program modules 42, may be stored in system memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

Figure 2:
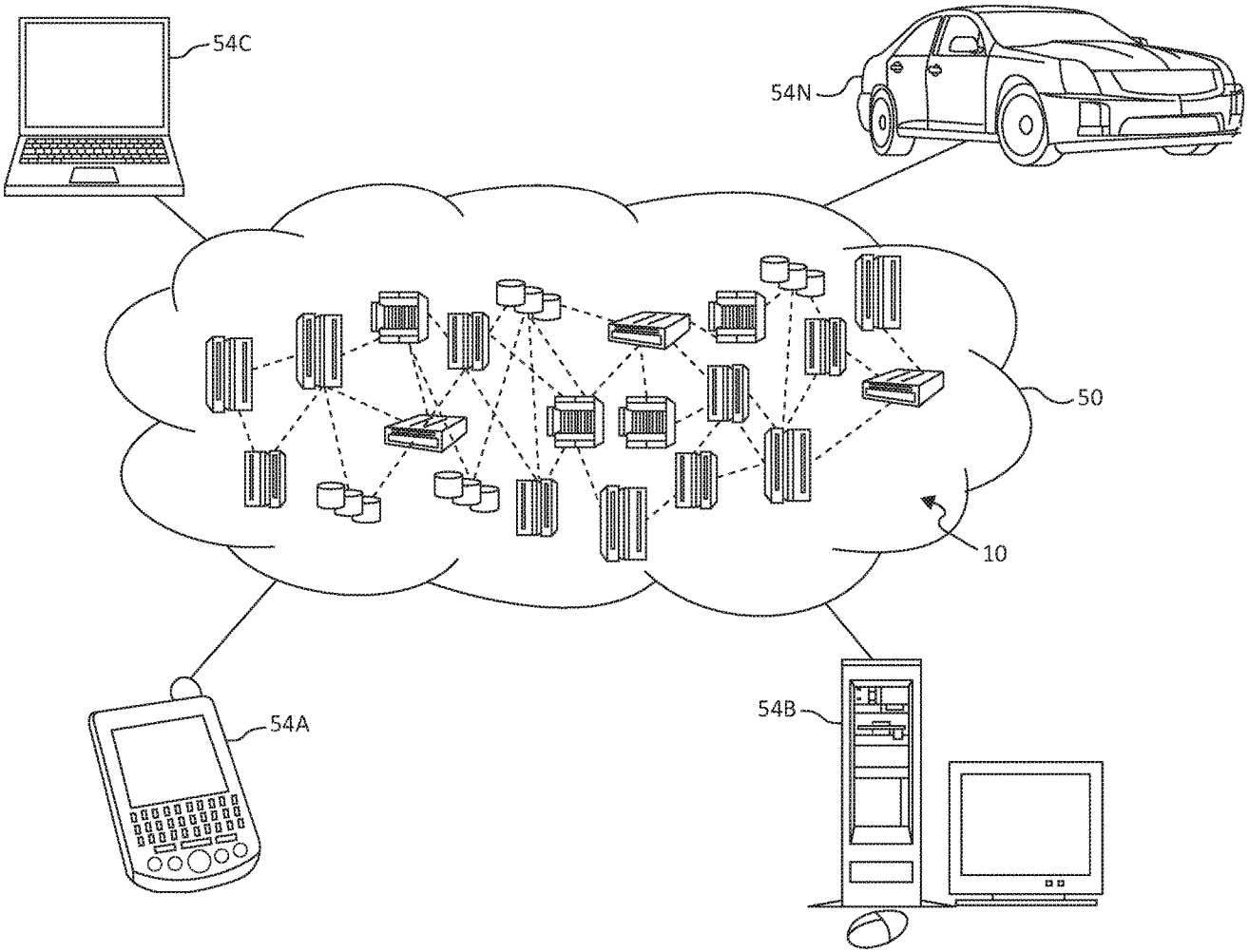
FIG. 2 is an additional block diagram depicting an exemplary cloud computing environment according to an embodiment of the present invention.

Referring now to FIG. 2, illustrative cloud computing environment 50 is depicted. As shown, cloud computing environment 50 comprises one or more cloud computing nodes 10 with which local computing devices used by cloud consumers, such as, for example, personal digital assistant (PDA) or cellular telephone 54A, desktop computer 54B, laptop computer 54C, and/or other type of computer systems 54N (e.g., an automobile computer system) may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 2 are intended to be illustrative only and that computing nodes 10 and cloud computing environment 50 can communicate with any type of computerized device over any type of network and/or network addressable connection (e.g., using a web browser).

Figure 3:
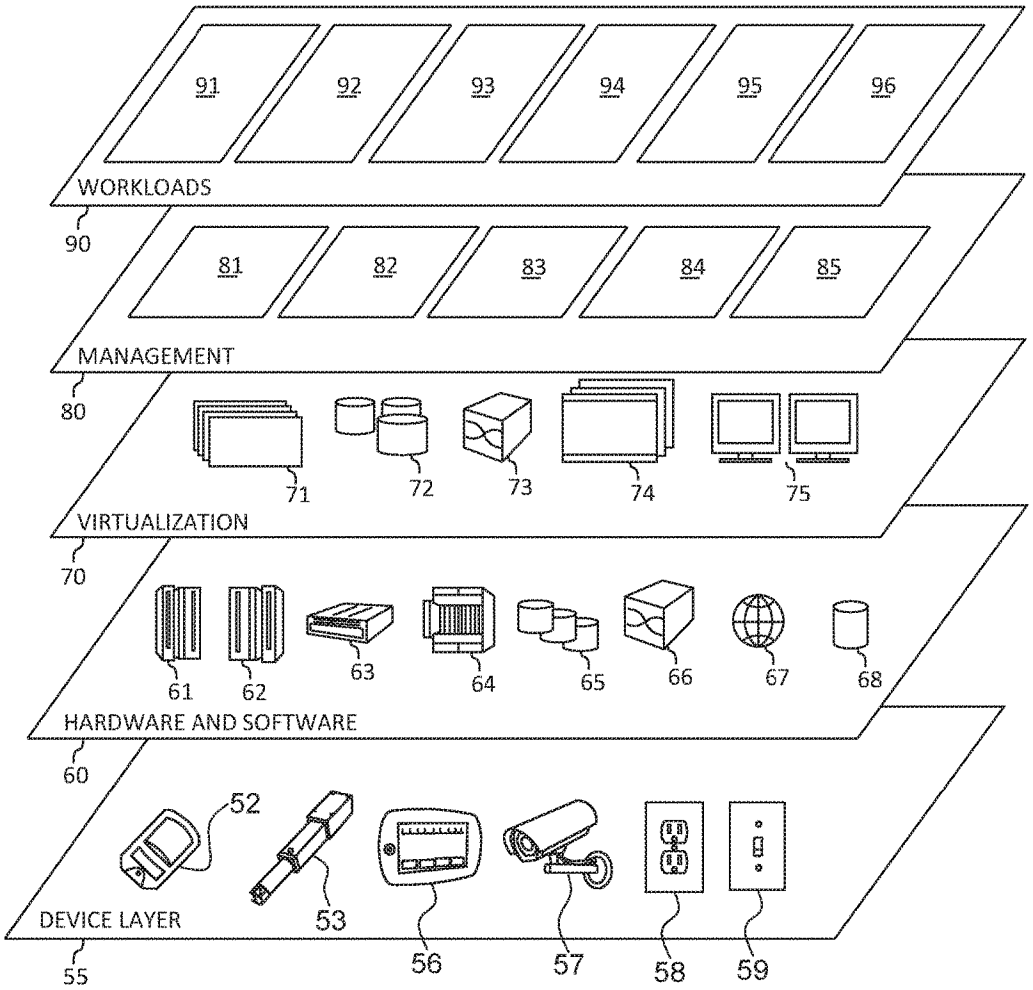
FIG. 3 is an additional block diagram depicting abstraction model layers according to an embodiment of the present invention.

Referring now to FIG. 3, a set of functional abstraction layers provided by cloud computing environment 50 (FIG. 2) is shown. It should be understood in advance that the components, layers, and functions shown in FIG. 3 are intended to be illustrative only and embodiments of the invention are not limited thereto. As depicted, the following layers and corresponding functions are provided:

Device layer 55 includes physical and/or virtual devices, embedded with and/or standalone electronics, sensors, actuators, and other objects to perform various tasks in a cloud computing environment 50. Each of the devices in the device layer 55 incorporates networking capability to other functional abstraction layers such that information obtained from the devices may be provided thereto, and/or information from the other abstraction layers may be provided to the devices. In one embodiment, the various devices inclusive of the device layer 55 may incorporate a network of entities collectively known as the "internet of things" (IoT). Such a network of entities allows for intercommunication, collection, and dissemination of data to accomplish a great variety of purposes, as one of ordinary skill in the art will appreciate.

Device layer 55 as shown includes sensor 52, actuator 53, "learning" thermostat 56 with integrated processing, sensor, and networking electronics, camera 57, controllable household outlet/receptacle 58, and controllable electrical switch 59 as shown. Other possible devices may include, but are not limited to various additional sensor devices, networking devices, electronics devices (such as a remote control device), additional actuator devices, so called "smart" appliances such as a refrigerator or washer/dryer, and a wide variety of other possible interconnected objects.

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provides cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provides pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and, in the context of the illustrated embodiments of the present invention, various workloads and functions 96 for implementing intelligent alarm sound control. In addition, the workloads and functions 96 for cognitive use of an intelligent hearing aid device may include such operations as data analytics, data analysis, and as will be further described, notification functionality. One of ordinary skill in the art will appreciate that the workloads and functions 96 for cognitive use of an intelligent hearing aid device may also work in conjunction with other portions of the various abstractions layers, such as those in hardware and software 60, virtualization 70, management 80, and other workloads 90 (such as data analytics processing 94, for example) to accomplish the various purposes of the illustrated embodiments of the present invention.

As previously stated, the present invention provides a novel solution for implementing intelligent alarm sound control by a processor. A sound of an IoT computing device may be isolated for waking a targeted, sleeping entity while simultaneously providing a noise cancellation operation for preventing an alternative sleeping entity from being disturbed by the isolated sound.

A directional sound, using the one or IoT computing devices, may be emitted within a cone of silence for waking a targeted, sleeping entity and preventing an alternative sleeping entity from being disturbed by the directional sound. The directional sound may be activated and isolated within the cone of silence for a selected period of time. An alternative sleeping entity may be located outside the cone of silence from the directional sound. The noise cancellation may be paired with the directional sound according to a predictive frequency, volume, and wavelength.

A preset frequency and sound pattern may be emitted for the isolated sound. Also, the preset frequency and the sound pattern may be paired with the isolated sound by the noise cancellation operation. A machine learning operation may be implemented to learn a plurality of sleep preferences for each user, historical sleeping activity patterns of the user, a cognitive state of the user, contextual factors, the one or more characteristics of the directional sound, feedback data collected from each entity, or a combination thereof.

Figure 4:
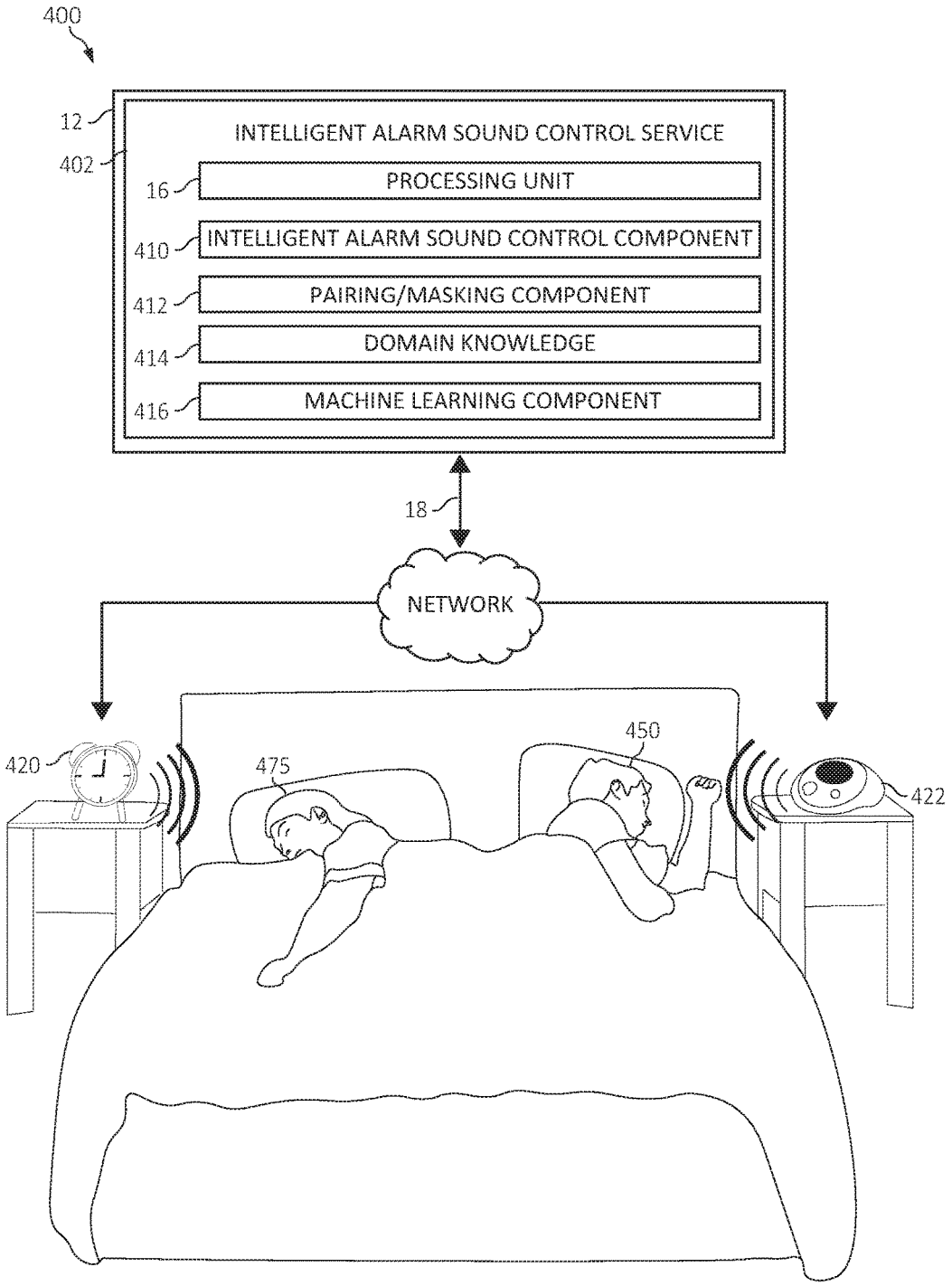
FIG. 4 is an additional block diagram depicting an exemplary functional relationship between various aspects of the present invention.

Turning now to FIG. 4, a block diagram depicting exemplary functional components 400 according to various mechanisms of the illustrated embodiments is shown. In one aspect, each of the devices, components, modules, and/or functions described in FIGS. 1-3 may also apply to the devices, components, modules, and functions of FIG. 4. Also, one or more of the operations and steps of FIGS. 1-3 may also be included in one or more operations or actions of FIG. 4. Computer system/server 12 is again shown, which may incorporate an intelligent alarm sound control service 402.

In one aspect, the computer system/server 12 may provide virtualized computing services (i.e., virtualized computing, virtualized storage, virtualized networking, etc.) to one or more computing devices, as described herein. More specifically, the computer system/server 12 may provide virtualized computing, virtualized storage, virtualized networking and other virtualized services that are executing on a hardware substrate.

The computer system/server 12 (e.g., a cognitive system) may include an intelligent alarm sound control service 402. The intelligent alarm sound control service 402 may be in communication with and/or association with one or more computing devices such as, for example, an IoT sound generating device 420 (e.g., an alarm clock, a smart phone, a smart watch, or other device capable of functioning as an alarm clock), and a noise cancellation device 422. In one aspect, the IoT sound generating device 420 and/or the noise cancellation device 422 may be a voice-activated hub (e.g., personal assistant, television, smart phone, desktop computer, laptop computer, tablet, smart watch and/or another electronic device that may have one or more processors, memory, and/or wireless communication technology). For example, the noise cancellation device 422 may be any device capable of emitting a sound wave with a same amplitude but with an inverted phase to the original sound (e.g., sound generated from IoT sound generating device 420).

The intelligent alarm sound control service 402, the IoT sound generating device 420 and/or the noise cancellation device 422 may each be associated with and/or in communication with each other, by one or more communication methods, such as a computing network, wireless communication network, or other network means enabling communication (each collectively referred to in FIG. 4 as "network 18"). In one aspect, the intelligent alarm sound control service 402 may be installed locally on the IoT sound generating device 420 and/or the noise cancellation device 422. Alternatively, the intelligent alarm sound control service 402 may be located external to (e.g., via a cloud computing server) each of the IoT sound generating device 420 and/or the noise cancellation device 422.

The intelligent alarm sound control service 402 may incorporate processing unit 16 to perform various computational, data processing and other functionality in accordance with various aspects of the present invention. The intelligent alarm sound control service 402 may include an intelligent alarm sound control component 410, a pairing/masking component 412, a domain knowledge 414 (e.g., a database/knowledge domain having a user profile, preferences, behaviors, etc.), and a machine learning component 416.

The domain knowledge 414 may be an ontology of concepts, keywords, expressions representing a domain of knowledge. A thesaurus or ontology may be used as the domain knowledge 414 and may also be used to identify semantic relationships between observed and/or unobserved variables by the machine learning component 416 (e.g., a cognitive component). In one aspect, the term "domain" is a term intended to have its ordinary meaning. In addition, the term "domain" may include an area of expertise for a system or a collection of material, information, content and/or other resources related to a particular subject or subjects. A domain can refer to information related to any particular subject matter or a combination of selected subjects.

The term ontology is also a term intended to have its ordinary meaning. In one aspect, the term ontology in its broadest sense may include anything that can be modeled as an ontology, including but not limited to, taxonomies, thesauri, vocabularies, and the like. For example, an ontology may include information or content relevant to a domain of interest or content of a particular class or concept. The ontology can be continuously updated with the information synchronized with the sources, adding information from the sources to the ontology as models, attributes of models, or associations between models within the ontology.

Additionally, the domain knowledge 414 may include one or more external resources such as, for example, links to one or more Internet domains, webpages, and the like. For example, text data may be hyperlinked to a webpage that may describe, explain, or provide additional information relating to sleeping preferences, interests, behaviors, patterns, biometric information, historical sleeping activity patterns of the user, a cognitive state of the user, contextual factors, characteristics of the directional sound.

In one aspect, the one machine learning component 416 may receive and/or collect from users 450, 475 one or more sleeping preferences, interests, behaviors, patterns, biometric information, historical sleeping activity patterns of the user, a cognitive state of the user, contextual factors, characteristics of the directional sound, feedback data collected from each entity etc., the IoT sound generating device 420 and/or the noise cancellation device 422. The collected/received data may be learned via a machine learning operation (via the machine learning component 416). The collected data may include, for example, a user profile, which may include sleep preferences (e.g., temperature of a room, wake-up times, sleep times, cognitive/emotional date, health state, ADL's, etc., of each user), historical activity/sleep behavior patterns of the users 450, 475 in relation to the intelligent alarm sound control service 402, the IoT sound generating device 420 and/or the noise cancellation device 422. The collected and learned data may also be stored with a keyword dictionary or ontology (e.g., a lexical database ontology), which may be associated with the central server, the cloud computing network, the local area network server, and/or the computing system 12. In one aspect, the intelligent alarm sound control component 410 of the computer system/server 12 may work in concert with processing unit 16 to accomplish various aspects of the present invention.

In one aspect, the intelligent alarm sound control component 410 may provide a directional sound, using one or more internet of things (IoT) computing devices (e.g., the IoT sound generating device 420) within a cone of silence for waking a targeted, sleeping entity while simultaneously providing noise cancellation operation for preventing an alternative sleeping entity from being disturbed by the directional sound via the noise cancellation device 422. The intelligent alarm sound control component 410 may also emit a preset frequency and sound pattern for the directional sound via the IoT sound generating device 420.

The pairing/masking component 412 may pair the noise cancellation operation with the directional sound operation according to a predictive frequency, volume, and wavelength. The pairing/masking component 412 may also mask a preset frequency and sound pattern for the directional sound by the noise cancellation operation.

The intelligent alarm sound control component 410 may activate and isolate the directional sound within the cone of silence for a selected period of time via the via the IoT sound generating device 420 while shielding the alternative sleeping entity located outside the cone of silence from the directional sound via the noise cancellation device 422.

In one aspect, the intelligent alarm sound control component 410 may also create, via the IoT sound generating device 420 and/or noise cancellation device 422 working in conjunction with each other, a cone of silence, which limits and/or restricts the sound of the IoT sound generating device 420 to the cone of silence. Those users such as, for example, user 475 outside of the cone of silence are unable to hear or be disturbed by the sound/alarm from the IoT sound generating device 420.

As previously indicated, the intelligent alarm sound control service 402 may also communicate with other linked devices such as, for example, the IoT sound generating device 420 and/or noise cancellation device 422 to further monitor any news, events, calendar updates and/or activities to dynamically learn a schedule of the users 450, 475 to active the intelligent alarm sound control service 402 for each of the users 450, 475 (e.g., a recently scheduled early morning flight indicates the user 450 must wake up 2 hours earlier than normal thereby dynamically updating and/or activating the intelligent alarm sound control service 402 to waken the user 450 at least 2 hours earlier than normal).

The machine learning component 416 may also various computing for detecting, learning, analyzing a conversation, and/or detecting a pattern for common interests. Moreover, the machine learning component 416 may even access one or more online data sources such as, for example, a social media network, website, or data site for detecting, learning, analyzing a conversation, and/or detecting sleep patterns, sleep behaviors, information impacting a time a user is required to waken, etc.

Figure 5A:
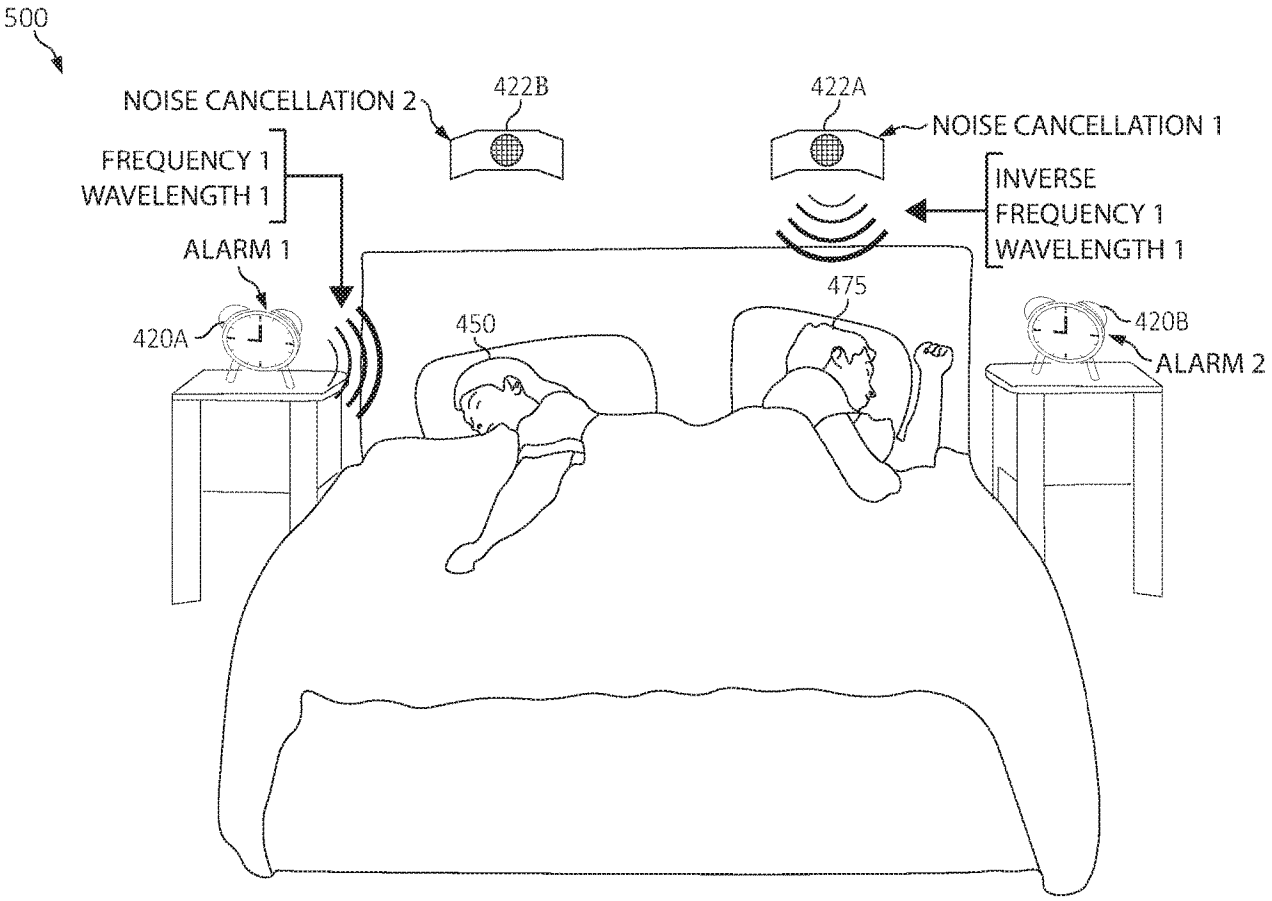
FIGS. 5A-5B are additional block diagrams depicting intelligent alarm sound control services employed in Internet of Things (IoT) computing environments in which aspects of the present invention may be realized.
Figure 5B:
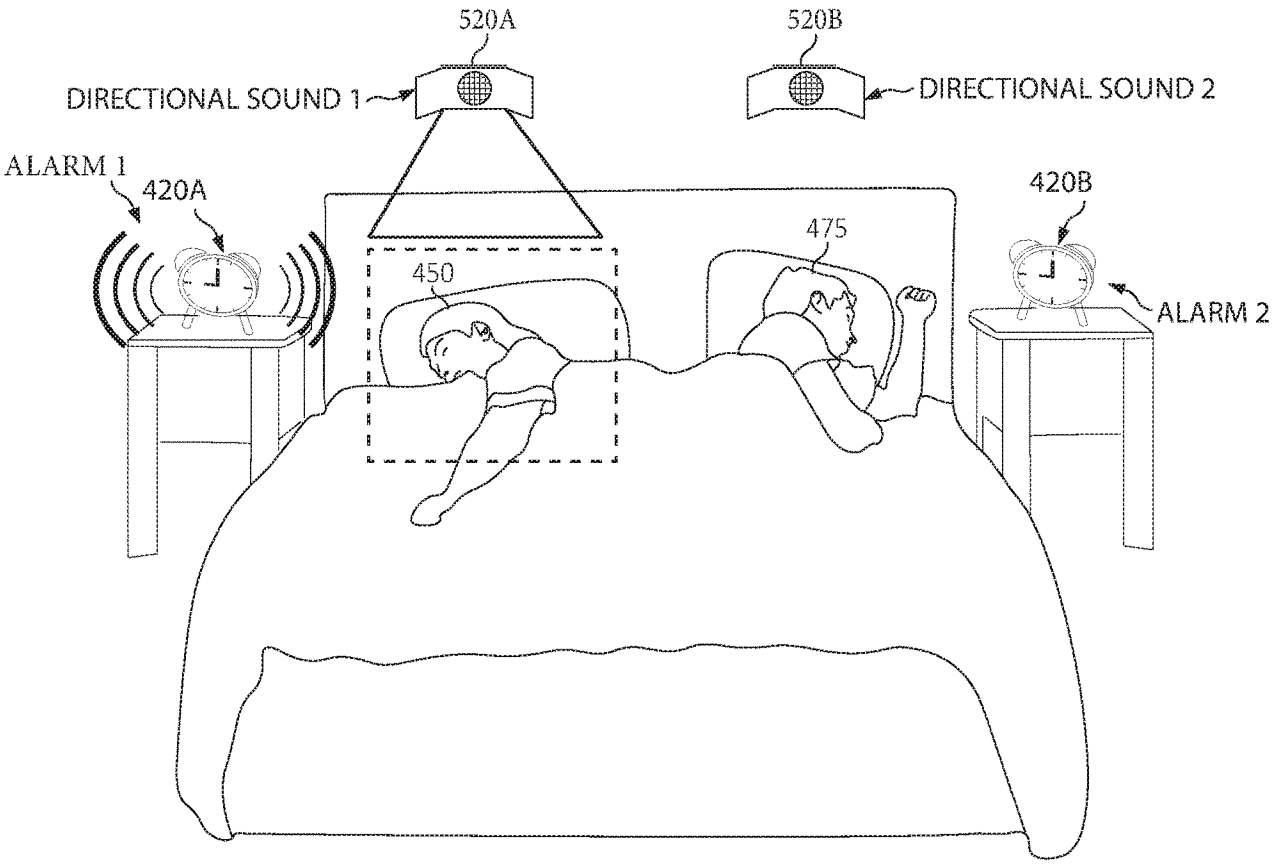

Turning now to FIGS. 5A-5B, block diagrams 500 and 525 depict exemplary use cases for employing intelligent alarm sound control services in an IoT computing environment. In one aspect, each of the devices, components, modules, and/or functions described in FIGS. 1-4 may also apply to the devices, components, modules, and functions of FIGS. 5A-5B. Also, one or more of the operations and steps of FIGS. 1-4 may also be included in one or more operations or actions of FIGS. 5A-5B. More specifically, block diagrams 500 and 525 depict employing the devices, components, modules, and/or functions as described in FIG. 4.

In a first exemplary use case of FIG. 5A, the noise cancellation devices 422A, 422B (e.g., one or more of the noise cancellation device 422 of FIG. 4) may be installed over each user's side of the bed such as, for example, user 450 and 475 (or other selected location). The noise cancelling operations may be matched with a sound emitted by the IoT sound generating device 420A (e.g., alarm clock) for user 450 and the IoT sound generating device 420B for user 475.

For example, the IoT sound generating device 420A may be located within a defined distance from user 450 (e.g., placed on a nightstand near user 450). The IoT sound generating device 420A may be paired with the noise cancellation device 422A for user 475 in a position opposite of user 450. The IoT sound generating device 420A may be preconfigured to emit a preset frequency and pattern for sound that can be masked by the predictive noise cancelling portion of the noise cancellation device 422A.

Alternatively, the IoT sound generating device 420B may be located within a defined distance from user 475 (e.g., placed on a nightstand near user 475). The IoT sound generating device 420B may be paired with the noise cancellation device 422B for user 450 in a position opposite of user 475. The IoT sound generating device 420B may be preconfigured to emit a preset frequency and pattern for sound that can be masked by the predictive noise cancelling portion of the noise cancellation device 422A.

In an additional exemplary use case of FIG. 5B, sound emitting devices 520A and 520B, in association with the IoT sound generating devices 420A and/or 420B respectively, can perform "directional sound" in a manner that only a targeted user (e.g., user 450 or user 475) at a particular location (e.g., on one side of a bed) can hear the alarm. It should be noted that the term "directional sound" may also be referred to as a "code of silence."

For example, the IoT sound generating device 420A may be located within a defined distance from a user (e.g., user 450 and the IoT sound generating device 420A placed on a nightstand near user 450). The IoT sound generating device 420A may be in wireless communication with the sound emitting devices 520A for user 450. Thus, the user 450 may set the IoT sound generating device 420A (e.g., alarm 1) and the sound emitting devices 520A will be connected with the set time to isolate the sound. Before the alarm alerts, the sound emitting devices 520A may activate and isolate the sound of the IoT sound generating device 420A by creating the cone of silence (e.g., directional sound 1) for a duration of time until the targeted user 450 has woken.

Alternatively, IoT sound generating device 420B may be located within a defined distance from a user (e.g., user 475 and the IoT sound generating device 420B placed on a nightstand near user 475). The IoT sound generating device 420B may be in wireless communication with the sound emitting devices 520B for user 475. Thus, the user 475 may set the IoT sound generating device 420B (e.g., alarm 2) and the sound emitting devices 520B will be connected with the set time to isolate the sound. Before the alarm alerts, the sound emitting devices 520B may activate and isolate the sound of the IoT sound generating device 420B by creating a cone of silence (e.g., directional sound 2) for a duration of time until the targeted user 475 has woken. It should be noted that in FIG. 5B only the cone of silence (e.g., directional sound 1) for the targeted user 450 is depicted for illustration purposes only.

Figure 6:
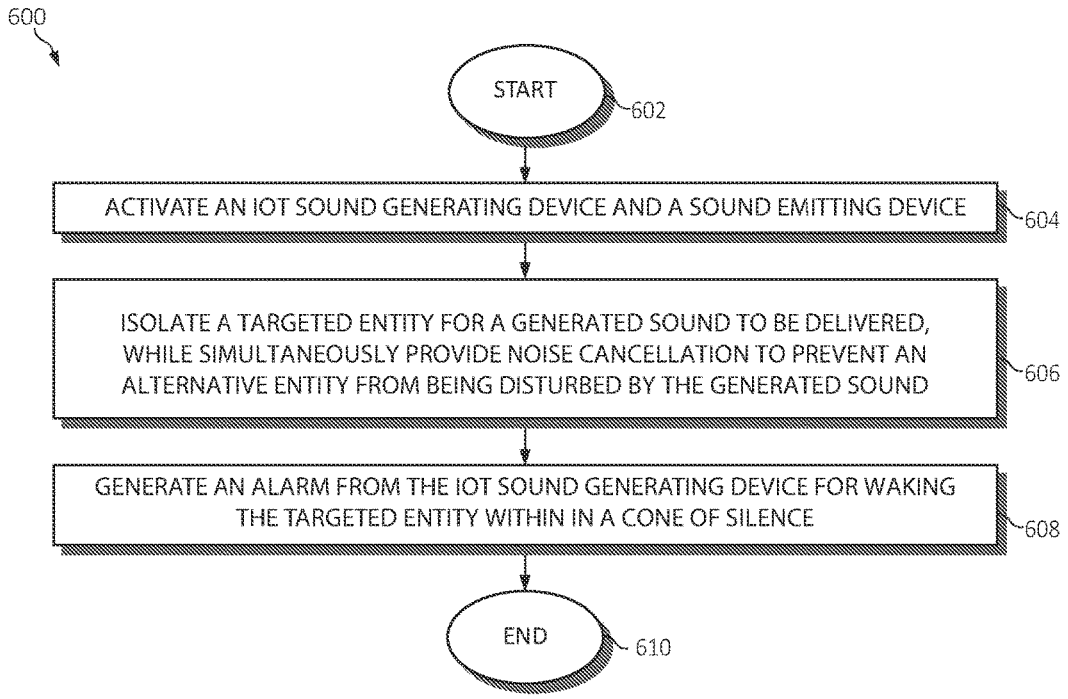
FIG. 6 is a flow chart diagram of an exemplary method for implementing intelligent alarm sound control by a processor, here again in which various aspects of the present invention may be implemented.

Turning now to FIG. 6, a method 600 for implementing intelligent alarm sound control by a processor is depicted. The functionality 600 may be implemented as a method executed as instructions on a machine, where the instructions are included on at least one computer readable medium or one non-transitory machine-readable storage medium. The functionality 600 may start in block 602.

An IoT sound generating device and a sound emitting device may be activated, as in block 604. A targeted entity may be isolated for a generated sound to be delivered, while noise cancellation is simultaneously provided to prevent an alternative entity from being disturbed by the isolated sound, as in block 606. An alarm is generated from the IoT sound generating device for waking the targeted entity within in the cone of silence, as in block 608. The functionality 600 may end in block 610.

Figure 7:
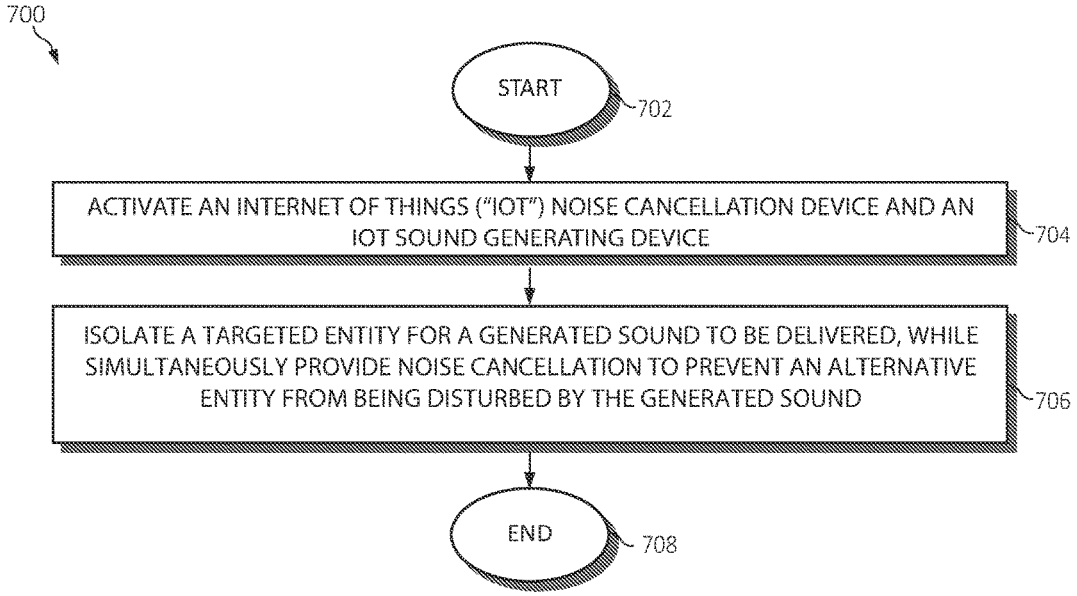
FIG. 7 is an additional flow chart diagram of an exemplary method for implementing intelligent alarm sound control by a processor, here again in which various aspects of the present invention may be implemented.

Turning now to FIG. 7, a method 700 for implementing intelligent alarm sound control by a processor is depicted. The functionality 700 may be implemented as a method executed as instructions on a machine, where the instructions are included on at least one computer readable medium or one non-transitory machine-readable storage medium. The functionality 700 may start in block 702.

An IoT noise cancellation device and an IoT sound generating device may be activated, as in block 704. A targeted entity may be isolated for a generated sound to be delivered, while noise cancellation is simultaneously provided to prevent an alternative entity from being disturbed by the isolated sound, as in block 706. The functionality 700 may end in block 708.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowcharts and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowcharts and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowcharts and/or block diagram block or blocks.

The flowcharts and block diagrams in the Figures illustrate the architecture, functionality, and operation of possible implementations of systems, methods, and computer program products according to various embodiments of the present invention. In this regard, each block in the flowcharts or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts or carry out combinations of special purpose hardware and computer instructions.

The invention claimed is:

1. A method for implementing intelligent alarm sound control by a processor, comprising:

isolating a targeted entity for a generated sound to be delivered, while simultaneously providing noise cancellation to prevent an alternative entity from being disturbed by the generated sound; wherein the generated sound is activated and isolated within a cone of silence for a selected period of time, and the alternative entity located outside the cone of silence is shielded from the generated sound by initiating the noise cancellation for a duration beginning prior to the selected period of time until the target entity performs a certain action.

2. The method of claim 1, further including providing the generated sound within the cone of silence for waking the targeted entity and preventing the alternative entity from being disturbed by the generated sound.

3. The method of claim 1, further including pairing the noise cancellation with the generated sound according to a predictive frequency, volume, and wavelength.

4. The method of claim 1, further including emitting a preset frequency and sound pattern for the generated sound.

5. The method of claim 4, further including masking the preset frequency and the sound pattern for the generated sound by the noise cancellation.

6. The method of claim 1, further including initiating a machine learning operation to learn a plurality of sleep preferences for each entity, historical sleeping activity patterns of the targeted entity, a cognitive state of the targeted entity, contextual factors, the one or more characteristics of the generated sound, feedback data collected from each entity, or a combination thereof.

7. A system for implementing intelligent alarm sound control, comprising:

one or more computing components associated with the intelligent alarm sound control with executable instructions that when executed cause the system to:

isolate a targeted entity for a generated sound to be delivered, while simultaneously provide noise cancellation to prevent an alternative entity from being disturbed by the generated sound; wherein the generated sound is activated and isolated within a cone of silence for a selected period of time, and the alternative entity located outside the cone of silence is shielded from the generated sound by initiating the noise cancellation for a duration beginning prior to the selected period of time until the target entity performs a certain action.

8. The system of claim 7, wherein the executable instructions further provide the generated sound within the cone of silence for waking the targeted entity and prevent the alternative entity from being disturbed by the generated sound.

9. The system of claim 7, wherein the executable instructions further pair the noise cancellation with the generated sound according to a predictive frequency, volume, and wavelength.

10. The system of claim 7, wherein the executable instructions further emit a preset frequency and sound pattern for the generated sound.

11. The system of claim 10, wherein the executable instructions further mask the preset frequency and the sound pattern for the generated sound by the noise cancellation.

12. The system of claim 7, wherein the executable instructions further initiate a machine learning operation to learn a plurality of sleep preferences for each entity, historical sleeping activity patterns of the targeted entity, a cognitive state of the targeted entity, contextual factors, the one or more characteristics of the generated sound, feedback data collected from each entity, or a combination thereof.

13. A computer program product for implementing intelligent alarm sound control by one or more processors, the computer program product comprising a non-transitory computer-readable storage medium having computer-readable program code portions stored therein, the computer-readable program code portions comprising:

an executable portion that isolates a targeted entity for a generated sound to be delivered, while simultaneously provide noise cancellation to prevent an alternative entity from being disturbed by the generated sound; wherein the generated sound is activated and isolated within a cone of silence for a selected period of time, and the alternative entity located outside the cone of silence is shielded from the generated sound by initiating the noise cancellation for a duration beginning prior to the selected period of time until the target entity performs a certain action.

14. The computer program product of claim 13, further including an executable portion that provides the generated sound within the cone of silence for waking the targeted entity and preventing the alternative entity from being disturbed by the generated sound.

15. The computer program product of claim 13, further including an executable portion that pairs the noise cancellation with the generated sound according to a predictive frequency, volume, and wavelength.

16. The computer program product of claim 13, further including an executable portion that:

emits a preset frequency and sound pattern for the generated sound; and masks the preset frequency and the sound pattern for the isolated sound by the noise cancellation.

17. The computer program product of claim 13, further including an executable portion that initiates a machine learning operation to learn a plurality of sleep preferences for each entity, historical sleeping activity patterns of the targeted entity, a cognitive state of the targeted entity, contextual factors, the one or more characteristics of the generated sound, feedback data collected from each entity, or a combination thereof.

* * * * *